US007661247B2

(12) United States Patent
Schwabel et al.

(10) Patent No.: US 7,661,247 B2
(45) Date of Patent: Feb. 16, 2010

(54) ABRASIVE ARTICLE PACKAGING AND METHOD OF MAKING SAME

(75) Inventors: Mark G. Schwabel, Lake Elmo, MN (US); Jeffrey W. Nelson, Bayport, MN (US); Joseph A. Scheller, Carlos, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 787 days.

(21) Appl. No.: 11/171,525

(22) Filed: Jun. 30, 2005

(65) Prior Publication Data

US 2007/0000214 A1 Jan. 4, 2007

(51) Int. Cl.
*B65B 53/00* (2006.01)

(52) U.S. Cl. ..... 53/472; 536/266.1; 536/285; 536/133.4; 536/139.2

(58) Field of Classification Search ..... 53/285, 53/266.1, 133.4, 139.2, 441, 442, 452, 472
See application file for complete search history.

(56) References Cited

U.S. PATENT DOCUMENTS

| | | | | |
|---|---|---|---|---|
| 2,209,715 | A | 7/1940 | Crupi | |
| 2,431,258 | A | 11/1947 | Kirchner | |
| 2,492,143 | A | 12/1949 | Gipple et al. | |
| 3,442,686 | A | 5/1969 | Jones | |
| 3,630,349 | A | 12/1971 | Rechberger | |
| 3,696,580 | A | 10/1972 | Saltzer, Sr. | |
| 3,708,946 | A * | 1/1973 | Cahill | 53/472 |
| 4,190,477 | A | 2/1980 | Ossian et al. | |
| 4,282,973 | A | 8/1981 | Binkowski | |
| 4,294,357 | A | 10/1981 | Stevens et al. | |
| 4,815,603 | A | 3/1989 | Harris | |
| 4,845,918 | A | 7/1989 | Klüpfel et al. | |
| 4,873,814 | A | 10/1989 | Harris | |
| 4,947,990 | A * | 8/1990 | Klemets | 206/409 |
| 4,988,554 | A | 1/1991 | Peterson et al. | |
| 5,037,459 | A | 8/1991 | Spruill et al. | |
| 5,139,878 | A | 8/1992 | Kim et al. | |
| 5,180,621 | A | 1/1993 | Heier et al. | |
| 5,485,918 | A * | 1/1996 | Lasenby et al. | 206/372 |
| 5,667,542 | A | 9/1997 | Law et al. | |

(Continued)

FOREIGN PATENT DOCUMENTS

| | | |
|---|---|---|
| EP | 0 034 898 | 9/1981 |
| FR | 2 698 855 | 12/1992 |
| GB | 1 382 842 | 2/1975 |
| WO | WO03/064111 | 8/2003 |

OTHER PUBLICATIONS

Wiley Encyclopedia of Packaging Technology 2nd ed., *Film, Shrink*, ed. Charles R. Jolley and George D. Wofford, pp. 431-434, New York: Wiley, 1997.

(Continued)

*Primary Examiner*—Thanh K Truong
(74) *Attorney, Agent, or Firm*—Scott A. Baum

(57) ABSTRACT

A system for packaging resin bonded molded abrasive articles having a flexible package comprising at least one sidewall defining an enclosed volume and at least one resin bonded abrasive article positioned within the enclosed volume. The sidewall comprises a multilayer barrier composite having a water vapor transmission rate that is less than 0.5 grams per 645 square centimeters (100 square inches) per 24 hours.

19 Claims, 1 Drawing Sheet

U.S. PATENT DOCUMENTS

| | | | | |
|---|---|---|---|---|
| 5,741,563 | A | 4/1998 | Mehta et al. | |
| 5,771,662 | A | 6/1998 | Struges et al. | |
| 5,874,035 | A | 2/1999 | Tsai et al. | |
| 5,888,648 | A | 3/1999 | Donovan et al. | |
| 5,992,630 | A | 11/1999 | Brown et al. | |
| 6,419,966 | B1 | 7/2002 | Davis | |
| 6,612,437 | B1 * | 9/2003 | Klemets | 206/445 |
| 6,949,129 | B2 | 9/2005 | Simon | |
| 2002/0088533 | A1 | 7/2002 | Mercure et al. | |
| 2002/0172435 | A1 | 11/2002 | Colombo et al. | |
| 2006/0000731 | A1 | 1/2006 | Hayne et al. | |
| 2006/0003121 | A1 * | 1/2006 | Scheller | 428/35.7 |
| 2006/0222797 | A1 * | 10/2006 | Bekele | 428/35.7 |

OTHER PUBLICATIONS

Handbook of Package Engineering 3rd Edition, *Technomic Publishing Co. Inc*., pp. 106-107, 1998.

Wiley Encyclopedia of Packaging Technology 2nd ed., *Multilayer Flexible Packaging*, pp. 659-665, New York: Wiley, 1997.

"Standard Test Method for Water Vapor Transmission Rate Through Plastic Film and Sheeting Using a Modulated Infrared Sensor", ASTM International, Designation: F1249—01, pp. 1-5.

Anon, "Avoiding Fusion", Storage Handling Distribution, vol. 29, No. 2, May 1985, pp. 11.

Mans, Jack; "Bag Filling Rocks: Hf/f/s Machine Runs 50- and 100-lb Bags of Landscape Materials at Speeds Of Up To 24 bags/min. (Horizontal form/fill/seal)", Packaging Digest, 39, 3, 56(2), Mar. 2002, Copyright 2002 Cahners Business Information.

Hartman, Lauren R.; "Plastic Packs With Vision. (Plastic Packaging Awards)", Packaging Digest, 38, 6, 54, Jun. 2001, Cahners Publishing Company.

"Shrink Wrap Output Speaks Volumes", Packaging Digest, vol. 32, No. 14, p. 86(3), Oct. 1995. Copyright 1995 Delta Communications Inc.

Calmes, Fred, "Films, Shrink. (Packaging Encyclopedia & Technical Directory)", Packaging (Boston, Mass.), vol. 34, No. 9, pp. 32(2), Jun. 19, 1989. Copyright 1989 Reed Publishing USA.

Beck, Bill, "Managing Oils Smarter", New Steel, 17, 2, 20, Feb. 2001. Copyright 2001 Cahners Publishing Company.

Anon, "A Specialist in Tamper Evident Packaging Film: Soretrac, County, Durham, UK", Food Packer International, vol. 18, No. 4, Apr. 2003, pp. 44-45.

Goerlitz, W., "Cycloolefin Copolymers: New Options To Meet Demanding Requirements In Films, Laminations and Extrusion Coating", 2001 8th European Polymers, Films, Laminations And Extrusion Coatings Conference, Barcelona, Spain, May 28-30, 2001, 7pp (Atlanta, Ga), TAPPI Press, 2001.

Choi, W.S. and Han, J.H., "Physical and Mechanical Properties of Pea-Protein-Based Edible Films", J. Food Sco. vol. 66, No. 2, Mar. 2001, pp. 319-322.

Anon, "Copolyesters", Research Disclosure No. 352, Aug. 1993, pp. 547.

Fowler, S., "Electronic Packaging for Next Century", Fowler Associates Inc., Antec 97, vol. II, Conference Proceedings, SPE, Toronto, Apr. 27-May 2, 1997, pp. 1296-1300. 012, Journal Announcement: 199709 RAPRA Update 199717.

"Double Bubble Answer To Economical Opp", British Plastics and Rubber, May 1988, pp. 27.

"Films Group Led by R&D: The UCB Group's Already-Considerable Films Research", World Tobacco, 195, 21(4), Jul. 2003.

"A Complete Package" A New Pallet Package Allows A Printer To Compete In A Tough Market, Graphic Arts Monthly, vol. 68, No. 9, pp. 87(1), Sep. 1996.

"Free Samples", Food & Drug Packaging, vol. 65, No. 2, pp. 43, Feb. 2001.

Drugan, Cheryl Grazulis, "Packaging Inroads", Handling & Shipping Management, vol. 25, No. 12, pp. 63-66, Nov. 1984.

"Top Film Dispenser From Cyklop UK", Food Trade Review, 71, 8, 563, Aug. 2001.

"Pallet Ventilation For Breathable Products", Packaging Week, pp. 14, Jan. 2, 1997.

Yan Rui-jin, "Preventing grinding wheel from breaking in operation", *Journal of Harbin Bearing*, vol. 25, No. 2, (2004) pp. 27-30.

* cited by examiner

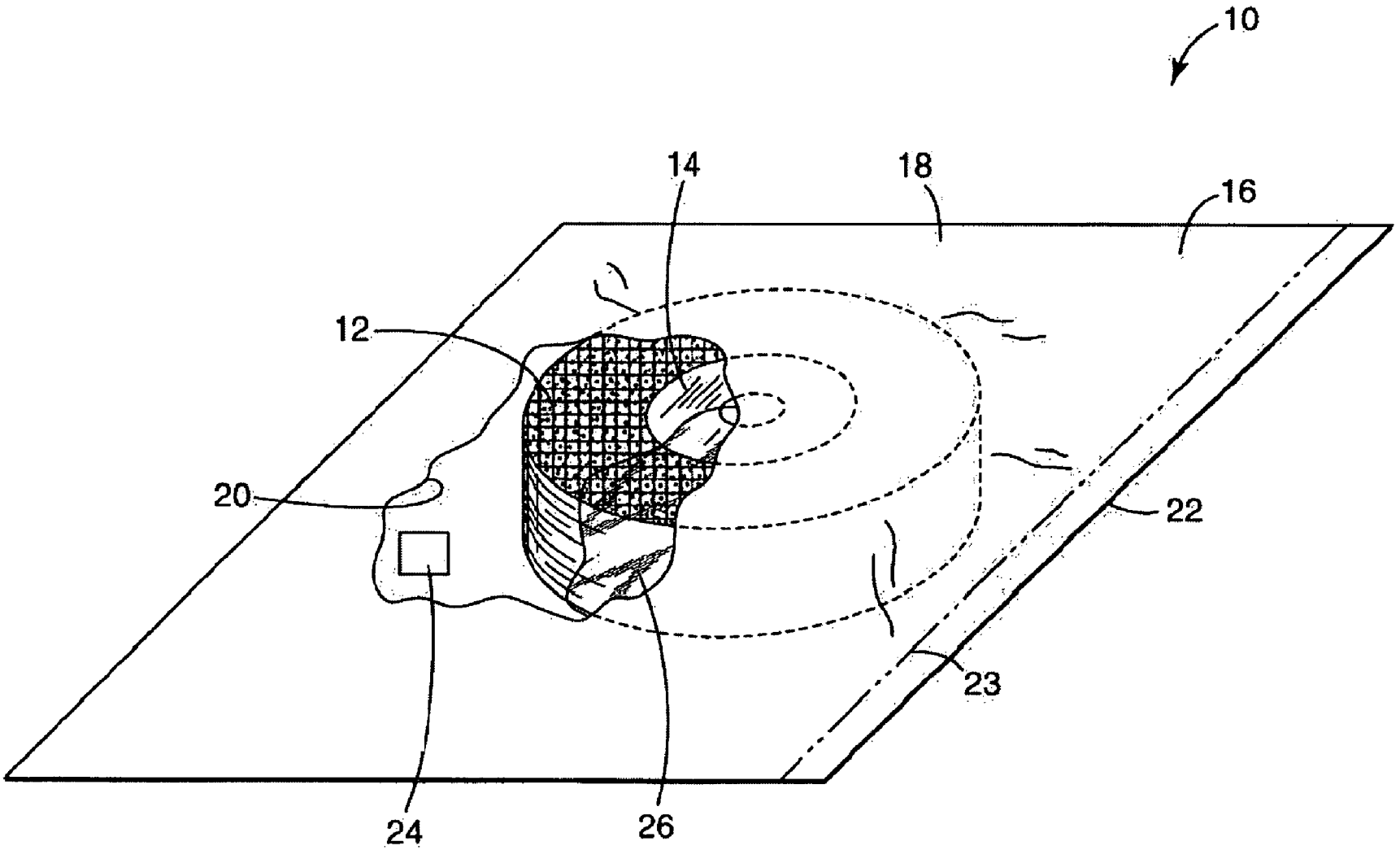
10
16
18
14
12
20
22
23
26
24

ABRASIVE ARTICLE PACKAGING AND METHOD OF MAKING SAME

BACKGROUND

Abrasive articles are generally manufactured at a first location, shipped to a distributor at a second location, and then to a customer at a third location where they are utilized. The environmental conditions during the shipment and storage of the abrasive article can negatively affect the performance of the abrasive article. For example, extended storage in humid conditions has been observed to negatively affect the performance of resin bonded abrasive articles, such as cut-off wheels.

Paper packaging, including for example, cardboard, has been used to package a variety of abrasive articles to help contain the abrasive articles and reduce their exposure to environmental conditions. The cardboard packaging allows air and moisture to transfer through and subjects the packaged abrasive article to environmental fluctuations. Shrink wrap has also been used to package a variety of abrasive articles to help reduce packaging costs and reduce exposure to environmental conditions. When shrink wrap is used, the abrasive articles to be packaged are typically enclosed in the shrink wrap. The enclosure is then subjected to an environment with an elevated temperature that causes the shrink wrap to shrink around the abrasive articles to produce a tight wrapping that closely conforms to the outer contour of the abrasive articles. Vents, such as a series of pinholes, are usually provided in the shrink wrap to allow the enclosed air to evacuate during the shrinking process. After wrapping, the shrink wrap allows air and moisture to transfer through the shrink wrap and subjects the packaged abrasive article to environmental fluctuations.

SUMMARY

The present invention provides a system for packaging resin bonded abrasive articles. In one aspect, the present invention provides a system for packaging resin bonded abrasive articles having a flexible package comprising at least one sidewall defining an enclosed volume. The sidewall comprises a multilayer barrier composite having an inner surface proximate the enclosed volume, an outer surface opposite the inner surface, and a water vapor transmission rate that is less than 0.5 grams per 645 square centimeters (100 square inches) per 24 hours. At least one resin bonded abrasive article is positioned within the enclosed volume. The resin bonded abrasive article comprises a molded body comprising a plurality of abrasive particles and at least one binder resin.

In some embodiments, the resin bonded abrasive article is a cut-off wheel comprising a plurality of abrasive particles, a scrim reinforcing material (e.g., fiberglass), at least one filler and/or grinding aid, and binder resin. In some embodiments, the resin bonded abrasive article is a molded grinding wheel comprising a plurality of abrasive particles, at least one filler and/or grinding aid, and binder resin.

In some embodiments, the multilayer barrier composite comprises aluminum. In certain embodiments, the multilayer barrier composite comprises at least one of polyethylene, polypropylene, and nylon.

In some embodiments, the multilayer barrier composite has a water vapor transmission rate that is less than 0.1 grams per 645 square centimeters (100 square inches) per 24 hours. In other embodiments, the multilayer barrier composite has a water vapor transmission rate that is less than 0.01 grams per 645 square centimeters (100 square inches) per 24 hours.

In some embodiments, the system for packaging abrasive articles comprises a plurality of resin bonded cut-off wheels. The resin bonded cut-off wheels can comprise a reinforcing material.

The present invention also provides methods for packaging abrasive articles according to the present invention.

Packaging systems of the present invention have been observed to be effective at sustaining the performance of resin bonded molded abrasive articles subjected to uncontrolled environmental conditions and/or extended storage after manufacture.

BRIEF DESCRIPTION OF THE DRAWING

The drawing is a perspective view of a quantity of resin bonded cut-off wheels in an exemplary packaging system of the present invention.

DETAILED DESCRIPTION

The packaging system of the present invention can be used to protect a variety of resin bonded abrasive articles from environmental conditions, including for example, resin-bonded cut-off wheels and resin bonded grinding wheels. The methods of making such abrasive products are well-known to those skilled in the art. Resin bonded abrasive grinding wheels, for example, typically consist of a shaped mass of abrasive grits held together by an organic binder material.

As shown in the drawing, a quantity of bonded abrasive cut-off wheels 12 is in a flexible package 10. The flexible package 10 has a sidewall 16 with an outer surface 18, an inner surface 20 opposite the outer surface 18, and a seal 22. The drawing also shows a label 14 affixed to the outer surface of the abrasive cut off-wheel. The flexible package 10 has an enclosed volume formed from sidewall 16. The bonded abrasive cut-off wheels 12 are positioned within the enclosed volume of the flexible package.

In one embodiment, the packaging system of the present invention is used to protect resin bonded cut-off wheels. Cut-off wheels are generally 0.8 mm (0.035 inch) to 16 mm (0.63 inch) thick, preferably 0.8 mm to 8 mm (0.315 inch), and have a diameter between about 2.5 cm (1 inch) and 100 cm (40 inches), although wheels as large as 152 cm (60 inches) in diameter are known. A center hole is used for attaching cut-off wheel to, for example, a power driven tool. The center hole is generally about 0.5 cm to 2.5 cm in diameter.

The cut-off wheels are generally made via a molding process. During molding, the binder or bonding medium, typically a liquid and/or powdered organic material, is mixed with abrasive grains. In some instances, a liquid medium (either resin or a solvent) is first applied to the grain to wet the abrasive grain's outer surface, and then the wetted grains are mixed with a powdered medium. The cut-off wheel may be made by compression molding, injection molding, transfer molding, or the like. The molding can be either by hot or cold pressing or any suitable manner known to those skilled in the art.

Phenolic resin is the most commonly used organic binder and is used in both the powder form and liquid state. Although phenolic resins are widely used, it is within the scope of this invention to use other organic binders. These binders include epoxy, phenoxy, urea formaldehyde, rubber, shellac, acrylate functional binders, and the like. The phenolic binder may also be modified with another binder materials to improve or alter the properties of the phenolic. For example, the phenolic may be modified with a rubber to improve the toughness of the overall binder.

Resin bonded abrasive articles that can be packaged using the packaging system of the present invention can comprise any known abrasive particles or materials commonly used in such abrasive articles. Examples of useful abrasive particles for resin bonded abrasives include, for example, fused aluminum oxide, heat treated aluminum oxide, white fused aluminum oxide, monocrystalline fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria and zirconia. Criteria used in selecting abrasive particles used for a particular abrading application typically include: abrading life, rate of cut, substrate surface finish, grinding efficiency, and product cost.

The resin bonded abrasive articles useful with the present invention may contain filler particles. Filler particles are added to the abrasive article to occupy space, improve resin properties and/or provide porosity. Porosity enables the cut-off wheel to "break down", i.e., to shed used or worn abrasive grain to expose new or fresh abrasive grain. This break down characteristic is strongly dependent upon the cut-off wheel formulation including the abrasive grain, binder or bonding medium, additives and the like.

A grinding aid particle, such as for example, cryolite, sodium chloride, potassium sulfate, barium sulfate, potassium aluminum fluoride, $FeS_2$ (iron disulfide), or $KBF_4$, can also be added to the resin bonded abrasive article. Grinding aids are added to improve the cutting characteristics of the abrasive article, generally by reducing the temperature of the cutting interface. The grinding aid may be in the form of single particles or an agglomerate of grinding aid particles.

A scrim reinforcing material can be incorporated into the cut-off wheel to improve the rotational burst strength, that is, the ability of the wheel to withstand the centrifugal forces produced by the wheel's rotation during use. The wear properties or heat resistance of the wheel may also be improved by using a scrim reinforcing material. Generally, one piece of scrim reinforcing material is located on each outer face of the wheel. Alternately, it is feasible to include one or more reinforcing scrim pieces inside the wheel for additional strength. The scrim may be made from any suitable material. For example, the scrim can be a woven or a knitted cloth. The fibers in the scrim are preferably made from glass fibers (e.g., fiberglass). In some instances, the scrim may contain a coupling agent treatment (e.g., a silane coupling agent). The scrim may also contain organic fibers such as polyamide, polyester, polyaramid, or the like.

In some instances, it may be preferred to include reinforcing staple fibers within the bonding medium, so that the fibers are homogeneously dispersed throughout the cut-off wheel.

The packaging system of the present invention can be used to protect a single abrasive article or a plurality of abrasive articles. For example, a large grinding wheel may be packaged independently. Alternatively, a plurality of resin bonded cut-off wheels may be packaged together. In some embodiments, the plurality of resin bonded cut-off wheels may be stacked. In other embodiments, the abrasive articles within the packaging system of the present invention are not stacked. The abrasive articles can be positioned proximate one another, for example, in a random or patterned arrangement.

The resin bonded abrasive articles useful with the packaging system of the present invention are preferably maintained in a dry condition when packaged. In some embodiments, the packaging system of the present invention maintains a humidity level of less than 20 percent relative humidity as measured at 20 degrees Celsius. In some embodiments, the packaging system of the present invention maintains a humidity level of less than 10 percent relative humidity as measured at 20 degrees Celsius. In yet further embodiments, the packaging system of the present invention maintains a humidity level of less than 5 percent relative humidity as measured at 20 degrees Celsius.

To assist in either establishing and/or maintaining a dry environment for the abrasive articles within the package of the present invention, a desiccant 24 can be placed within the package along with the abrasive article. The use of desiccants in packaging systems is generally known in the packaging industry, including, for example, the placement of desiccants (e.g., molecular sieve materials or silica gel materials) within a desiccant package, wherein the desiccant package is placed along with an article inside the article packaging.

The sidewall for the system for packaging abrasive articles of the present invention comprises a multilayer barrier composite having a water vapor transmission rate that is less than 0.5 gram per 645 square centimeters (100 square inches) per 24 hours. In some embodiments the sidewall for the system for packaging abrasive articles of the present invention comprises a multilayer barrier composite having a water vapor transmission rate that is less than 0.1 gram per 645 square centimeters (100 square inches) per 24 hours. In some embodiments the sidewall for the system for packaging abrasive articles of the present invention comprises a multilayer barrier composite having a water vapor transmission rate that is less than 0.01 gram per 645 square centimeters (100 square inches) per 24 hours The term multilayer barrier composite refers to any combination of metal, plastic, or cellulosic layers (e.g., foils, films, and paper). The combination of metal, plastic, or cellulosic layers can include multiple layers of different materials, such as, for example, a metal combined with a plastic layer. The combination of metal, plastic, or cellulosic layers can also include multiple layers of similar materials, such as, for example, two layers of plastic.

The layers can be combined substantially permanently using any processes known in the art, including, for example, coating, laminating, coextrusion, and deposition. Alternatively, the substrates can be temporarily combined by overlying one substrate over another. For example, an abrasive article can be wrapped with a polyethylene film and then wrapped in aluminum foil. In another embodiment, two plastic substrates can be combined for example, by wrapping an abrasive article with a first polyethylene film and then wrapping the wrapped abrasive article with a second polyethylene film. The first and second wraps of polyethylene film can be the same or be different from one another.

The term "water vapor transmission rate" refers to the rate of water vapor transmission through the multilayer barrier composite as measured using the test described in ASTM F1249-01, (Standard Test Method for Water Vapor Transmission Rate Through Plastic Film and Sheeting Using a Modulated Infrared Sensor, Published December 2001), incorporated herein by reference. The water vapor transmission rate for the multilayer barrier composite is determined using the composite structure. For example, if the sidewall comprises a film and a foil combined by overlying one another, the water vapor transmission rate would be determined by measuring the rate of vapor transmission through the combination of the film and foil. Likewise, the water vapor transmission rate of an abrasive article wrapped in three layers of shrink wrap would be determined by measuring the rate of vapor transmission through the combination of the three shrink wrap films.

Multilayer barrier composites useful in the packaging system of the present invention include multilayer barrier films with multiple layers that are affixed to one another, for example, by coating, laminating, coextrusion, or deposition.

Multilayer barrier films useful in the packaging system of the present invention can comprise layers of low-density polyethylene, high-density polyethylene, polypropylene, polyester, and nylon. In some embodiments, a multilayer barrier film having a layer of metal, such as, for example, aluminum is used. Multilayer barrier films are known and appropriate films and processes for manufacturing multilayer barrier films useful in the packaging system of the present invention are described in the Wiley Encyclopedia of Packaging Technology 2$^{nd}$ ed., *Multilayer Flexible Packaging,* ed. Dunn, Thomas J., 659-665, New York: Wiley, 1997, which pages are incorporated by reference.

In some embodiments, the sidewall comprises a multilayer barrier film having a layer of nylon adhesively affixed to a layer of aluminum, which is adhesively affixed to a layer of polyester film, which is adhesively affixed to a layer of polyethylene film. The polyethylene layer of the sidewall is located at the inner surface of the sidewall and the nylon layer is located at the outer surface of the sidewall.

In other embodiments, the sidewall comprises a multilayer barrier film having a layer of nylon affixed to a layer of polyethylene film, which is affixed to a layer of aluminum, which is affixed to a layer of polyethylene film. The polyethylene layer of the sidewall is located at the inner surface of the sidewall and the nylon layer is located at the outer surface of the sidewall.

In some embodiments, the sidewall comprises a multilayer barrier film having a heat sealable material at the inner surface of the sidewall. The heat sealable material can be used to convert the multilayer barrier film into a flexible package using commercially available sealing equipments such as, for example, a model "RTP1" sealer available from Packrite Division of Mettler-Toledo, Inc. Racine, Wis.

In certain embodiments, the flexible package of the present invention comprises a reclosable seal 23. The reclosable seal can be a mechanical zipper, an adhesive strip (as shown), a string or wire tie, or other reclosable seals known in the art. In other embodiments, the abrasive article is sealed within the flexible package such that the sidewall must be breached to remove the abrasive article. In yet further embodiments, the flexible package of the present invention includes a sealed sidewall that must be breached and a reclosable seal.

Multilayer barrier composites useful in the packaging system of the present invention also include multiple layers of films, metals, or cellulosic substrates that are not affixed to one another. For example, in some embodiments, the multilayer barrier composite can comprise multiple layers of shrink wrap films, such as, for example, linear low-density polyethylene (LLDPE) shrink-wrap film available from Bemis Clysar, Oshkosh, Wis., and marketed under the trade designation "CLYSAR ABL". Shrink wrapping is well known and appropriate films and processes for shrink wrapping are described in the Wiley Encyclopedia of Packaging Technology 2$^{nd}$ ed., *Films, Shrink,* ed. Jolley, Charles R., and George D. Wofford, 431-34, New York: Wiley, 1997, which pages are hereby incorporated by reference herein.

Heat shrinkable material useful for the packaging system of the present invention may comprise any of the uniaxially or biaxially oriented polymeric films that upon application of heat are shrunk to a decreased surface area. Suitable films include, for example, oriented polyolefinic films such as polyethylene, polypropylene, polyisopropylethylene, polyisobutylethylene, and copolymers thereof. Other films that may be useful are polyvinyl chloride, polyethylene terepthalate, polyethylene-2,6-napthalate, polyhexamethylene adipamide, as well as polymers of alpha mono-olefinically unsaturated hydrocarbons having polymer-producing unsaturation such as butene, vinyl acetate, methylacrylate, 2-ethyl hexyl acrylate, isoprene, butadiene acrylamide, ethylacrylate, N-methyl-n-vinyl acetamide, and the like. In certain embodiments, polyolefin, preferably biaxially oriented polyethylene, is used.

In some embodiments, the abrasive articles are wrapped in a single layer of shrink wrap 26 and then placed in a flexible package. If the shrink wrap covers a substantial portion of the abrasive article, the shrink wrap can function as a layer of a multilayer composite that forms the sidewall of the flexible package. The shrink wrap can also serve as a protective layer to help reduce the likelihood of the abrasive article positioned within the enclosed volume of the flexible package from damaging the flexible package. For example, if a multilayer barrier film with an aluminum layer is used as the sidewall, shrink wrap over the abrasive article can reduce the potential for the abrasive article to damage the sidewall and potentially puncture the aluminum layer.

The protective layer can also be made from other materials, such as, for example, paper, cardboard, foam, or plastic. In some embodiments, the protective layer is constructed of a pliable shock absorbing material, such as, for example, cushion wrap or bubble wrap. In some embodiments, the protective layer is positioned proximate to the abrasive surface and/or back surface of the abrasive article and does not fully cover the abrasive article. For example, a protective layer comprising a sheet of cardboard may be placed on the top and bottom of a stack of abrasive discs prior to placement in the flexible package. In other embodiments, a protective layer can be placed around the side of a stack of abrasive discs.

Advantages and other embodiments of this invention are further illustrated by the following examples, but the particular materials and amounts thereof recited in this example, as well as other conditions and details, should not be construed to unduly limit this invention. For example, the type of abrasive article wrapped and the particular packaging geometries used to create the inner and outer wrappers and their vents can vary. All parts and percentages are by weight unless otherwise indicated.

EXAMPLES

Cutting Test

The Cutting Test was used to compare the efficiency of a cut-off wheel to make multiple cuts through 15.8 mm outside diameter by 12.7 mm inside diameter. (⅝ in o.d.×0.5 in i.d.) type 304 stainless steel tubing. A right angle grinder (600 watt, 11,000 RPM (no load), model # 9523NBH, obtained from Makita U.S.A, La Mirada, Calif.) fitted with the preweighed cut-off wheel to be tested was mounted in a test frame such that the cut-off wheel could be brought into contact vertically with a horizontally-secured length of the stainless steel tubing. The grinder was activated and lowered onto the tubing under a constant load of 22.3 newtons (5 pounds). The time required to cut through the tubing was measured. The grinder was raised, the tubing indexed, and the process repeated until the cut-off wheel was sufficiently worn such that its diameter was no longer sufficient to cut through the tubing. The final weight of the cut-off wheel and total number of cuts made was recorded, the times summed, and the average time per cut calculated.

Resin Bonded Cut-Off Wheel Preparation

A cut off-wheel consisting of 63 parts of a low bulk density version of an abrasive grain marketed under the trade designation CUBITRON 321 ABRASIVE GRAIN, from 3M Company, St. Paul, Minn., was mixed with 5 parts liquid phenolic resin in a paddle mixer. Meanwhile, 14.5 parts dry powdered phenolic resin and 17.6 parts potassium sulfate were mixed together. The wet mixture of resin and abrasive grain was slowly added to the dry powder mixture and tumbled. The resulting homogenous particulate mixture was screened to provide uniform particles. These were loaded into the hopper of a hydraulic press. A die, corresponding to the dimensions of the resulting cut-off wheel (10.2 cm diameter, 0.12 cm thick, with a 0.95 cm diameter center hole (4 in.× 0.047 in.×0.375 in.)), was placed in the press. A fiberglass scrim was inserted in the bottom of the die, enough resin mixture to fill the die was added, and a second scrim was placed over the mixture. The combination was then pressed at about 2120-3170 kg/cm (30,000-40,000 psi) to produce a "green" (i.e., uncured) wheel. The resulting green wheel was placed between steel plates and Teflon coated mats that were stacked and compressed at about 7 kg/cm (100 psi). The compressed stack, under pressure, was placed in an oven that was heated to 185 degrees Celsius over about 16 hours, and then maintained at temperature for about 16 hours, and cooled. The total heating and cooling cycle was about 40 hours. The wheels were removed from the oven and then the center arbor holes were reamed to the standard size. The wheels were maintained in a dry condition by placing in a drying oven at 32 degrees Celsius (90 degrees Fahrenheit).

Testing Conditions

Control: Resin bonded cut-off wheels used as the Control were maintained in a drying oven at 32 degrees Celsius (90 degrees Fahrenheit).

Comparative Example

Resin bonded cut-off wheels used as the Comparative Example were placed in an environmental chamber conditioned at 32 degrees Celsius (90 degrees Fahrenheit), 90 percent relative humidity, without packaging.

Example 1

Resin bonded cut-off wheels used as Example 1 were sealed in foil bags having a reported water vapor transmission rate of less than 0.0004 gram per 100 square inches per 24 hours as measured using ASTM F1249-01, (Standard Test Method for Water Vapor Transmission Rate Through Plastic Film and Sheeting Using a Modulated Infrared Sensor, Published December 2001). The foil bags were provided by TechniPac Incorporated, LeSueur, Minn. The sealed packages were placed in an environmental chamber conditioned at 32 degrees Celsius (90 degrees Fahrenheit), 90 percent relative humidity.

Example 1, Control, and Comparative Examples were tested according to the Cutting Test. The Control and Comparative Examples were tested at 29 days and 50 days. The results (average of 4 tests) are reported in Table 1.

TABLE 1

| | | Comparative | | Example 1 | |
|---|---|---|---|---|---|
| | Control | 29 days | 50 days | 29 days | 50 days |
| Weight loss, g | 0.8 | 3.4 | 3.9 | 1.3 | 1.4 |
| Number of cuts | 96 | 30 | 24 | 74 | 53 |
| Average total cut time, sec | 182 | 154 | 111 | 277 | 184 |
| Average individual cut time, sec | 1.9 | 5.2 | 4.7 | 3.8 | 3.5 |

It is to be understood that even in the numerous characteristics and advantages of the present invention set forth in above description and examples, together with details of the structure and function of the invention, the disclosure is illustrative only. Changes can be made to detail, especially in matters of shape, size and arrangement of the abrasive article packaging and methods of making within the principles of the invention to the full extent indicated by the meaning of the terms in which the appended claims are expressed and the equivalents of those structures and methods.

What is claimed is:

1. A system comprising:

a flexible package comprising at least one sidewall of an enclosed volume, said sidewall comprising a multilayer barrier composite having an inner surface proximate said enclosed volume, an outer surface opposite said inner surface, and a water vapor transmission rate that is less than 0.5 grams per 645 square centimeters per 24 hours; and at least one resin bonded abrasive article positioned within said enclosed volume, said resin bonded abrasive article comprising a molded abrasive body comprising a plurality of abrasive particles and at least one binder resin and a humidity level of less than 20 percent relative humidity as measured at 20 degrees Celsius is maintained in the enclosed volume.

2. The system of claim 1 wherein said multilayer barrier composite comprises aluminum.

3. The system of claim 2 wherein said multilayer barrier composite comprises at least one of polyethylene, polypropylene, and nylon.

4. The system of claim 1 wherein said multilayer barrier composite comprises at least one of polyethylene, polypropylene, and nylon.

5. The system of claim 1 wherein said multilayer barrier composite has a water vapor transmission rate that is less than 0.1 grams per 645 square centimeters per 24 hours.

6. The system of claim 5, wherein the humidity level is less than 10 percent relative humidity as measured at 20 degrees Celsius.

7. The system of claim 5, wherein the humidity level is less than 5 percent relative humidity as measured at 20 degrees Celsius.

8. The system of claim 1 wherein said multilayer barrier composite has a water vapor transmission rate that is less than 0.01 grams per 645 square centimeters per 24 hours.

9. The system of claim 1 wherein said at least one abrasive article comprises at least one of a grinding wheel or a cut-off wheel.

10. The system of claim 9, wherein the humidity level is less than 10 percent relative humidity as measured at 20 degrees Celsius.

11. The system of claim 9, wherein the humidity level is less than 5 percent relative humidity as measured at 20 degrees Celsius.

12. The system of claim 1 wherein said at least one abrasive article comprises a plurality of cut-off wheels.

13. The system of claim 1 further comprising a protective layer positioned between at least a portion of said at least one resin bonded abrasive article and said inner surface of said sidewall.

14. The system of claim 13 wherein said protective layer comprises at least one of paper, cardboard, foam, plastic, cushion wrap, or bubble wrap.

15. The system of claim 14 wherein said protective layer comprises a shrink wrap film covering at least a portion of said at least one resin bonded abrasive article.

16. The system of claim 1 wherein said flexible package comprises a reclosable seal.

17. The system of claim 1 further comprising a desiccant.

18. The system of claim 1, wherein the humidity level is less than 10 percent relative humidity as measured at 20 degrees Celsius.

19. The system of claim 1, wherein the humidity level is less than 5 percent relative humidity as measured at 20 degrees Celsius.

* * * * *